US007954918B2

(12) United States Patent
Kasai et al.

(10) Patent No.: US 7,954,918 B2
(45) Date of Patent: Jun. 7, 2011

(54) LIQUID DISCHARGE HEAD SUBSTRATE AND LIQUID DISCHARGE HEAD HAVING REDUCED HEAT ENABLE WIRING

(75) Inventors: Ryo Kasai, Tokyo (JP); Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 187 days.

(21) Appl. No.: 11/949,590

(22) Filed: Dec. 3, 2007

(65) Prior Publication Data

US 2008/0150984 A1 Jun. 26, 2008

(30) Foreign Application Priority Data

Dec. 22, 2006 (JP) ..... 2006-346200

(51) Int. Cl.
*B41J 29/38* (2006.01)
*B41J 2/145* (2006.01)
*B41J 2/05* (2006.01)

(52) U.S. Cl. ..... 347/12; 347/40; 347/57

(58) Field of Classification Search ..... 347/57, 347/12, 5

See application file for complete search history.

(56) References Cited

U.S. PATENT DOCUMENTS

| | | | | |
|---|---|---|---|---|
| 4,710,649 | A * | 12/1987 | Lewis | 326/113 |
| 6,224,184 | B1 * | 5/2001 | Imanaka et al. | 347/19 |
| 6,382,755 | B1 * | 5/2002 | Imanaka et al. | 347/12 |
| 6,464,329 | B1 * | 10/2002 | Koitabashi et al. | 347/40 |
| 6,582,041 | B1 * | 6/2003 | Tsuruoka | 347/12 |
| 7,588,304 | B2 * | 9/2009 | Kasai et al. | 347/12 |
| 2001/0008405 | A1 * | 7/2001 | Yamane et al. | 347/12 |
| 2004/0021717 | A1 * | 2/2004 | Nakajima et al. | 347/12 |
| 2005/0134620 | A1 * | 6/2005 | Hirayama et al. | 347/9 |

* cited by examiner

*Primary Examiner* — Shelby Fidler
(74) *Attorney, Agent, or Firm* — Canon USA, INc. IP Div

(57) ABSTRACT

A selection circuit receives heat-enable signals to drive heaters, whereby signals are selected to drive the heaters.

4 Claims, 13 Drawing Sheets

FIG. 9

| | | BEDATA LOGIC | | | |
|---|---|---|---|---|---|
| | | BEDATA1 | BEDATA2 | BEDATA3 | BEDATA4 |
| SELECTED HEATER | HEATER 1 | Low | Low | Low | Low |
| | HEATER 2 | High | Low | Low | Low |
| | HEATER 3 | Low | High | Low | Low |
| | HEATER 4 | High | High | Low | Low |
| | HEATER 5 | Low | Low | High | Low |
| | HEATER 6 | High | Low | High | Low |
| | HEATER 7 | Low | High | High | Low |
| | HEATER 8 | High | High | High | Low |
| | HEATER 9 | Low | Low | Low | High |
| | HEATER 10 | High | Low | Low | High |
| | HEATER 11 | Low | High | Low | High |
| | HEATER 12 | High | High | Low | High |
| | HEATER 13 | Low | Low | High | High |
| | HEATER 14 | High | Low | High | High |
| | HEATER 15 | Low | High | High | High |
| | HEATER 16 | High | High | High | High |

| HE1 | HE2 | SELECT | HE_OUT |
|---|---|---|---|
| Low | Low | Low | Low |
| High | Low | Low | High |
| Low | High | Low | Low |
| High | High | Low | High |
| Low | Low | High | Low |
| High | Low | High | Low |
| Low | High | High | High |
| High | High | High | High |

FIG. 12

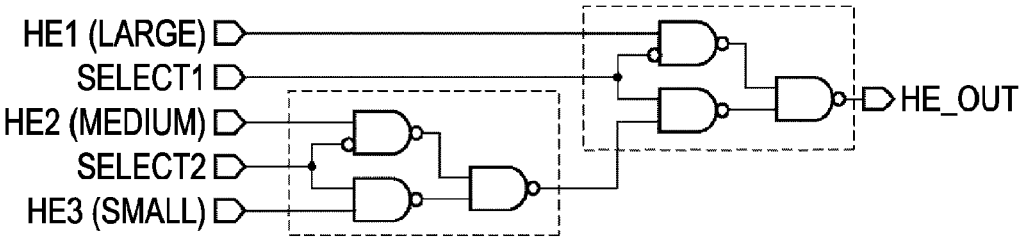

| HE1 | HE2 | HE3 | SELECT1 | SELECT2 | HE_OUT |
|---|---|---|---|---|---|
| Low | Low | Low | Low | Low | Low |
| High | Low | Low | Low | Low | High |
| Low | High | Low | Low | Low | Low |
| High | High | Low | Low | Low | High |
| Low | Low | High | Low | Low | Low |
| High | Low | High | Low | Low | High |
| Low | High | High | Low | Low | Low |
| High | High | High | Low | Low | High |
| Low | Low | Low | Low | High | Low |
| High | Low | Low | Low | High | High |
| Low | High | Low | Low | High | Low |
| High | High | Low | Low | High | High |
| Low | Low | High | Low | High | Low |
| High | Low | High | Low | High | High |
| Low | High | High | Low | High | Low |
| High | High | High | Low | High | High |
| Low | Low | Low | High | Low | Low |
| High | Low | Low | High | Low | Low |
| Low | High | Low | High | Low | High |
| High | High | Low | High | Low | High |
| Low | Low | High | High | Low | Low |
| High | Low | High | High | Low | Low |
| Low | High | High | High | Low | High |
| High | High | High | High | Low | High |
| Low | Low | Low | High | High | Low |
| High | Low | Low | High | High | Low |
| Low | High | Low | High | High | Low |
| High | High | Low | High | High | Low |
| Low | Low | High | High | High | High |
| High | Low | High | High | High | High |
| Low | High | High | High | High | High |
| High | High | High | High | High | High |

LIQUID DISCHARGE HEAD SUBSTRATE AND LIQUID DISCHARGE HEAD HAVING REDUCED HEAT ENABLE WIRING

BACKGROUND OF THE INVENTION

1. Field of the Invention

The present invention relates to a liquid discharge head substrate and liquid discharge head, and in particular relates to a circuit configuration and liquid discharge head of a liquid discharge head substrate, wherein multiple types of droplet amounts of ink can be discharged in the case of discharging ink with an inkjet method and performing recording onto a recording medium.

2. Description of the Related Art

Liquid discharge heads typically have a heating element (e.g. a heater) at a portion communicating to a discharge port to discharge liquid such as ink provided thereto. An electrical current is applied to the heater to generate heat and boil the ink, thereby discharging ink to perform recording.

However, there has been demand regarding the above-described liquid discharge head regarding improved image quality, higher speed, and lower cost.

In recent years, recording an image with high accuracy by discharging small droplets of ink of under 1 pl has become possible, but with recording only with such small droplets, an image must be formed with a large number of dots, which has the problem of taking a long time for recording. To mitigate such a problem, there is a method wherein large droplets and small droplets are combined within one recording image. In this case a head is configured such that multiple types of liquid droplet amounts of ink can be discharged. Depending on the form, an image may be formed with large droplets only, realizing higher speed, or large droplets and small droplets can be combined to obtain a recording image with high speed and high image quality. Also, by increasing the types of liquid droplet amounts and combining a medium droplet covering between the large droplets and small droplets, a high-resolution image can be obtained with high accuracy and high speed.

Even in fields other than that of recording, there is a demand for discharging large droplets and small droplets. As will be described later, generally a circuit is configured to receive a heat-enable signal for specifying a period to drive each heater and generate heat, so as to be driven for the predetermined period.

As described above, in the case of discharging large droplets and small droplets, in recent years configuration examples have been increasing wherein for example two or more types of heat-enable signals with differing driving time periods (pulse widths) are input to one liquid discharge head. This is so that the energy applied to the heater is changed in accordance with the amount with ink discharge, to discharge two or more types of liquid droplet amounts of ink.

On the other hand, as a method for recording with a greater speed, in recent years there has been a trend toward lengthening the head substrate and increasing the number of heating elements. With such a method, the recording area for each scan of a carriage with a head mounted thereupon is increased, facilitating forming an image at a higher speed. However, such an increasing in heating elements not only increases the size in the substrate lengthwise direction, but also requires additional circuits to drive the additional heating elements, which increases the substrate size in the widthwise direction also. Therefore, the substrate area overall tends to increase greatly.

Generally a semiconductor wafer is employed for an element substrate, so in order to lower the cost of the element substrate, the area of each element substrate needs to be shrunk and the number of element substrates which can be taken from one wafer needs to be increased, but the number of element substrates to be taken from each wafer tends to be decreasing in accordance with increased speeds.

U.S. Published Patent Application No. 2005/0134620 discloses an invention provided to suppress large increases in element substrate area even if the number of heating elements greatly increase. The subject invention has a circuit configuration for each group in increments of a predetermined number of adjoining heating elements. This configuration has an element base unit of the recording head provided for each group which includes an element selection circuit for selecting a common heating element (heater) within each group based on the recording data and a driving selection circuit for selecting one of the recording elements within each group.

An example is disclosed wherein at least one of the element selection circuit and driving selection circuit is disposed adjoined to the driving circuit of each group. That is to say, an example is disclosed wherein a shift register or latch which receives and holds recording data of a number of bits corresponding to the number of groups of time-shared driving is disposed adjacent to a logic circuit for each block.

FIG. 1 illustrates a layout of the element substrate corresponding to the invention disclosed in US Published Patent Application No. 2005/0134620. This configuration includes an ink supply port 101 in the central portion of the substrate and a voltage conversion circuit 107 for generating voltage to drive a driver transistor 103 which is provided at the end portion of the substrate, corresponding to each heater serving as a switching element for whether or not to drive the heater. Also, circuits such as shift registers 106 and latch circuits 105 are disposed along the lengthwise direction of the substrate near the corresponding group of heaters 102 and driver transistors 103.

The shift register 106 is a shift register of 1 bit which synchronizes with the clock signal CLK 109 and serially transfers and stores the recording data. The latch 105 holds the serial data in accordance with the latch signal LT 108. The heaters 102 are divided into M groups of N heaters each. The increments of this group corresponds to the time-shared driving whereby the number of heaters driven simultaneously within one group is one heater. Similarly, the output from the driver transistors 103 and logic circuits 104 also form M groups of N units each.

In addition to the M shift registers as described above, this configuration has n shift registers on the end portion of the substrate, thereby having a total of M+n common shift registers for each heater row. The M+n shift registers 106 and latch circuits 105 are serially connecting.

14 Also, the substrate has a n to N decoder 201 which receives an n-bit time-sharing (block) control signal for driving the multiple heaters with a shifted driving timing in increments of blocks to perform so-called time-sharing driving, and outputs a block selection signal of N bits.

FIG. 2 illustrates a circuit configuration of the inner portion of the logic circuit 104. The recording data (DATA 1 through M) held at the latch circuit is input in a common manner into multiple AND circuits serving as heater selection circuits within each group. The logic circuit takes the recorded data transmitted from the latch 105, the block selection signal from the n to N decoder 201, and the heat-enable (HE) signal for specifying the driving time period (heating time) of the heater as an AND operation with the AND circuit. Selection of the heater for driving and regulation of driving time is then performed. Upon the signal taking this AND operation being boosted with a level converter 205, this is transferred to an arbitrary driver 103, whereby the heater is selectively driven.

Of the M+n shift registers 106 and latches 105, the M first half transfers the data corresponding to the group (1 through M) to the logic circuits 104 within the group. Also, the n latter half of shift registers 106 and latches 105 store and transfer the data for inputting into the n to N decoder 201. The n data (BEDATA 1 through BEDATA n) is converted to a signal for sequentially selecting one of the N heaters within the group by the n to N decoder 201, and is transferred to the logic circuit within each group by the N BLE wirings 204.

By inputting two or more heat-enable signals into one liquid discharge substrate, for example the types of liquid droplet amount of ink can be increased, whereby a recording image with high image quality and high speed can be obtained. However, in accordance with the increasing in number of heat-enable (HE) signals, wiring and circuits for receiving the multiple heat-enable signals and differentiating the use of the heat-enable signals are necessary, whereby the substrate size increases greatly.

With the invention disclosed in US Published Patent Application No. 2005/0134620, the element substrate surface area can be suppressed from increasing greatly even if the number of recording elements increases greatly, thus is a configuration highly effective for higher speed and lower cost, but if this configuration is employed, the element driving circuits are disposed along the array of the recording elements in a long and narrow arrangement. Therefore, if the HE signal increases, not only for the amount of the increased circuits as described above, but the wiring corresponding to the multiple types of HE signals must also be laid, leading to increased substrate size.

FIG. 3 is a logic circuit diagram for one heater row in the case of inputting two types of HE signals into one head substrate. By the number of HE signal types increasing, the HE signal wirings 202 to be laid are increased, whereby the logic circuits 206 wherein the HE signals are input also increase. The HE delay circuits 203 for driving the heater current to be simultaneously driven in each group with a time shift, and reducing noise, also increases.

SUMMARY OF THE INVENTION

The present invention is made with consideration of the above-mentioned problems, and provides for a liquid discharge head with low cost while including technology for higher image quality.

According to an exemplary embodiment of the present invention, a liquid discharge head substrate includes a plurality of types of heaters configured to discharge differing amounts of liquid; a circuit configured to receive recording data and a heat-enable signal for regulating the driving time period for the heater to selectively drive the plurality of heaters; and a selection circuit wherein the plurality of types of heat-enable signals corresponding to each of the plurality of types of heaters are input, each with differing wiring, and output by selecting one of the plurality of types of heat-enable signals employing a selecting signal input externally.

With the configuration according to an embodiment of the present invention, a circuit configuration for driving differing types of heaters has a selection circuit for heat-enable signals. Therefore the number of wiring of the heat-enable signals input into the logic circuit within each time-sharing group near the heater can be reduced, and a liquid discharge head wherein the increase in substrate size can be suppressed while controlling the multiple types of heat-enable signals, can be realized.

Also, in accordance with the reduction of heat-enable wiring, the logic configuration within the group can be simplified, and the circuit layout area can be reduced.

Further features and aspects of the present invention will become apparent from the following description of exemplary embodiments (with reference to the attached drawings).

BRIEF DESCRIPTION OF THE DRAWINGS

FIG. 9 is a conversion chart of a 4 to 16 decoder given as one example of an n to N decoder.

FIG. 12 is a circuit diagram illustrating an HE selector 401 according to a third embodiment.

DESCRIPTION OF THE EMBODIMENTS

Various embodiments, features and aspects of the present invention will be described specifically in further detail with reference to the appended drawings.

It is noted that in this specification, "recording" (in some cases may be called "printing") is not restricted to only significant information such as text and graphics, and does not differentiate between significant and insignificant information. Also, this indicates cases of forming images, designs, patterns, and so forth in a wide variety on a recording medium without distinguishing whether or not that which is to be recorded can be recognized by the human eye, and also indicates cases of processing of the medium.

Also, "recording medium" indicates not only paper which is used in a general recording apparatus, but also widely includes materials which can be subjected to ink application such as cloth, plastic film, metallic plate, glass, ceramics, wood, leather, and so forth.

Further, "ink" (in some cases may be called "liquid") is to be widely interpreted similar to the above "recording (printing)" definition. Accordingly, this indicates a liquid which forms images, designs, patterns or the like or processes the recording medium by being applied to the recording medium, or which is subjected to processing of the ink (e.g., coagulating or insolubilizing of color material in the ink applied to the recording medium).

Moreover, "recording element" collectively refers to elements generating energy which are employed for ink discharge at the discharge port and the liquid path communicating therewith, unless specifically described as being otherwise.

Additionally, the "head substrate" employed below does not indicate a simple base unit made of a silicon conductor, but rather indicates a configuration wherein the various elements and wiring is provided thereto.

Furthermore, the phrase "on the substrate" indicates not only simply above the element substrate, but also indicates the inner side of the element substrate such as the surface of the element and surface vicinity.

Also, "build-in" or "built-in" as used in the present invention is not a term to indicate that each of elements are disposed as separate units on the base unit surface, but indicates that each element is formed and manufactured in an integrated manner on the element substrate by a manufacturing process or the like of the semiconductor circuit.

First Exemplary Embodiment

[Description of Example Inkjet Recording Apparatus]

Figure 4:
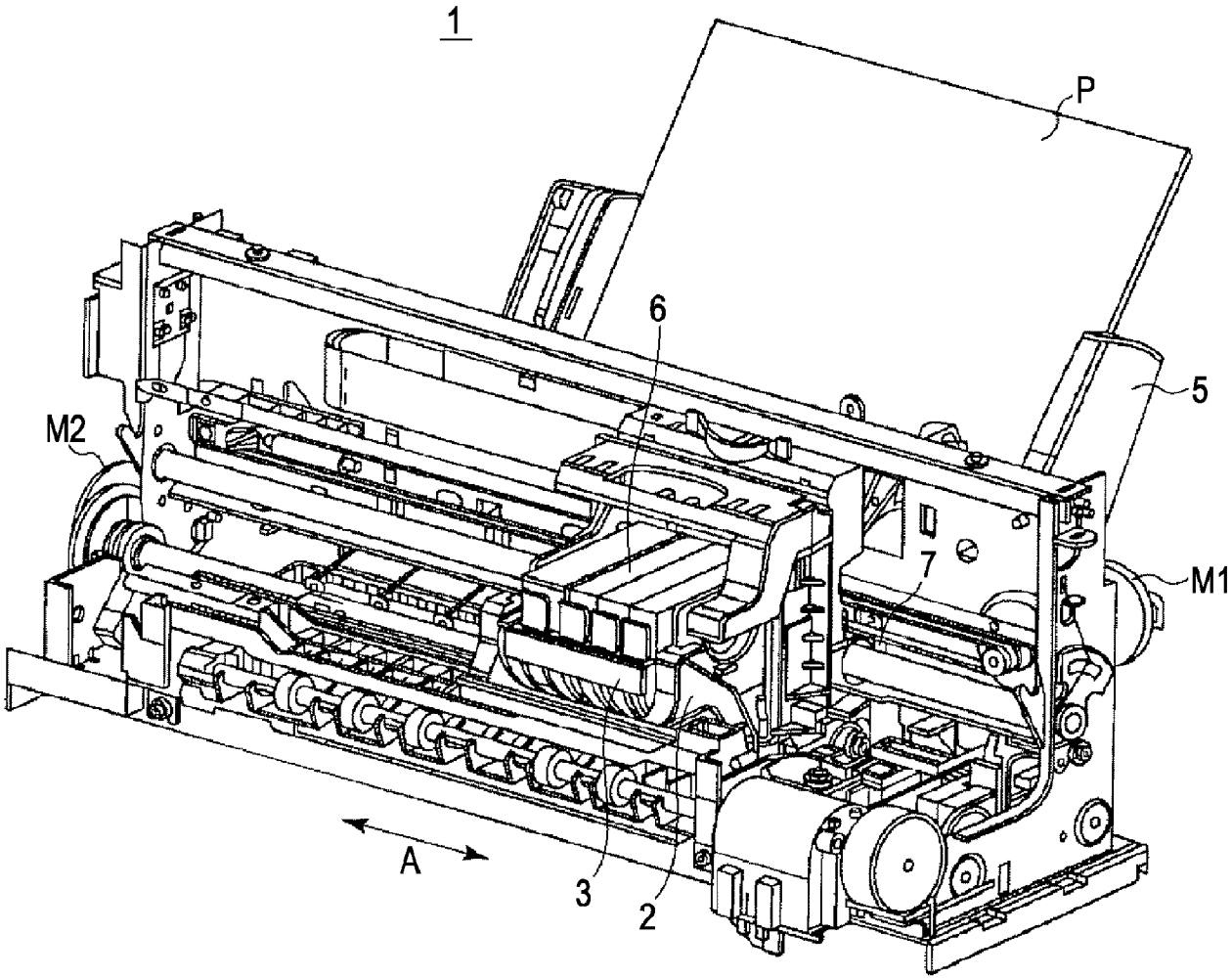
FIG. 4 is a diagram illustrating an overall example configuration of a recording apparatus to which the present invention is applied.

FIG. 4 is an external perspective diagram showing the overall configuration of an inkjet recording apparatus 1 which is a representative example of the present invention. As shown in FIG. 4, the inkjet recording apparatus (hereafter called "recording apparatus") has a recording head 3 to discharge ink according to an inkjet method and perform recording mounted on a carriage 2.

The carriage 2 is moved back and forth in the arrow A direction to perform recording. At the time of recording, for example, a recording medium P such as recording paper is supplied via a paper supplying mechanism 5, transported to the recording location, and performs recording by discharging ink to the recording medium p from the recording head 3 at the recording position thereof.

The carriage 2 of the recording apparatus has not only a recording head 3 mounted thereupon, but also has an ink cartridge 6 holding ink to be supplied to the recording head 3 attached thereto.

Figure 2:
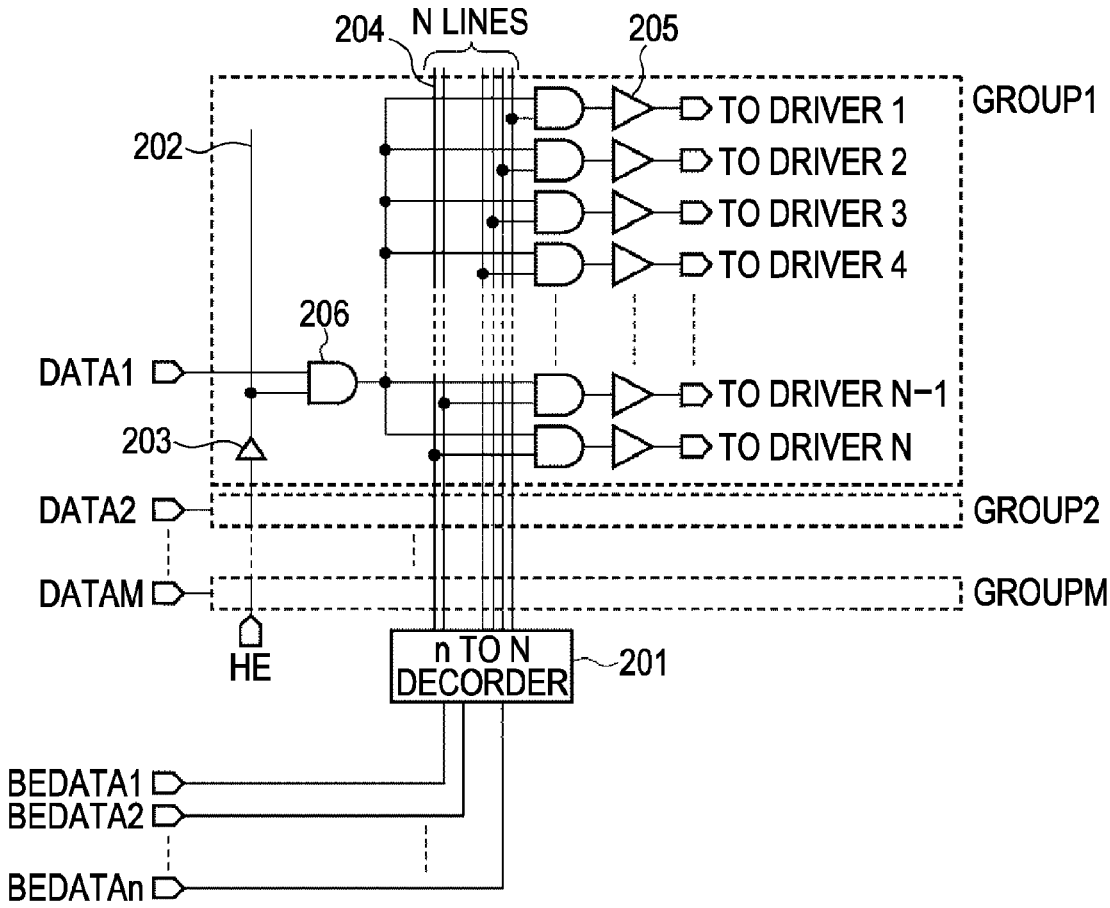
FIG. 2 PRIOR ART
FIG. 2 is a circuit configuration diagram of a logic circuit 104 according to a known arrangement.

The recording apparatus shown in FIG. 2 can perform color recording, so for this purpose four ink cartridges in the colors magenta (M), cyan (C), yellow (Y), and black (K) are each mounted on the carriage 2. These four ink cartridges are each independently detachably attached.

The carriage 2 and recording head 3 are arranged so that the joining face on both members correctly make contact whereby necessary electrical connection can be achieved and maintained. The recording head 3 selectively discharges ink from the multiple discharge ports and performs records by applying energy in accordance with the recording signals. In particular, the recording head 3 according to the present embodiment has an electrical heat converting unit (heater). The electrical energy applied to the electrical heat converting unit is converted to heat energy, and by using pressure changes generated by expanding and shrinking of air bubbles from the film boiling generated by applying the heat energy to the ink, ink is discharged from the discharge port. The electrical heat conversion unit is provided corresponding to each of the discharge ports, whereby ink is discharged from the corresponding discharge port by applying pulse voltage to the corresponding electrical heat converting unit.

Also, the recording apparatus 1 has a platen (not shown) provided facing the discharge port face whereupon the discharge port (not shown) of the recording head 3 is formed. Simultaneous to the carriage 2 whereupon the recording head 3 is mounted is moved back and forth with the driving force of a carriage motor M1, by applying a recording signal to the recording head 3 to discharge the ink, recording is performed over the entire width of the recording medium P transported onto the platen.

[Example Control Configuration of Inkjet Recording Apparatus]

Figure 5:
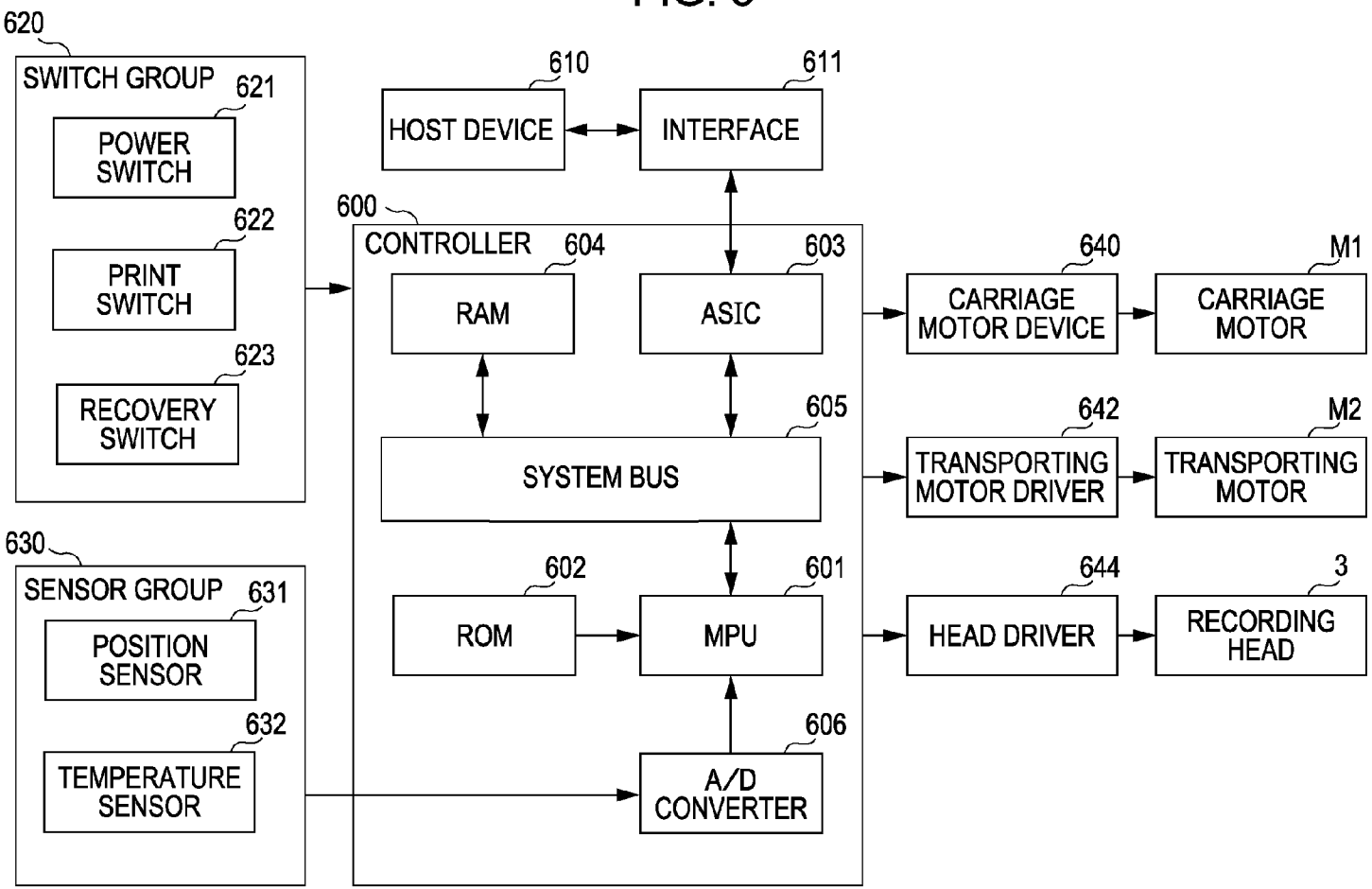
FIG. 5 is a diagram illustrating an example control configuration of a recording apparatus to which the present invention is applied.

FIG. 5 is a block diagram showing a control configuration of the recording apparatus shown in FIG. 4. A controller 600 is made up of a MPU 601, ROM 602, application-specific integrated circuit (ASIC) 603, RAM 604, system bus 605, A/D converter 606 and so forth. The ROM 602 stores a program corresponding to a control sequence to be described later, required tables, and other fixed data. The ASIC 603 generates control signals for controlling the carriage motor M1, controlling a transporting motor M2, and controlling the recording head 3. The RAM 604 is employed as an image data expanding region or a work region or the like for executing a program. The system bus 605 mutually connects the MPU 601, ASIC 603, and RAM 604 to perform data exchange. The A/D converter 606 inputs an analog signal from the sensor group to be described below and performs A/D conversion, supplying a digital signal to the MPU 601.

Also, as shown in FIG. 5, 610 denotes a computer serving as a supply source for image data (or a reader or digital camera or the like for image reading) and is called a host apparatus. Image data, commands, status signals, and the like are transmitted/received between the host apparatus 610 and the recording apparatus via an interface (I/F) 611. This image data is input with a raster format, for example.

Further, reference numeral 620 denotes a switch group, and is made up of a power switch 621, print switch 622, recovery switch 623 and the like. Reference numeral 630 denotes a sensor group for detecting an apparatus status, which is made up of a location sensor 631, temperature sensor 632, and the like.

Further, reference numeral 640 denotes a carriage motor driver to drive the carriage motor M in order to move the carriage 2 back and forth in the arrow A direction, and 642 denotes a transporting motor driver to drive the transporting motor M2 for transporting the recording medium P. Reference numeral 644 denotes a head driver to drive the recording head 3.

Additionally, control signals are supplied to the recording head 3 from the MPU 601 or ASIC 603 via the head driver 644. Also, power from the power source unit (unshown) is also supplied to the recording head 3.

Figure 6:
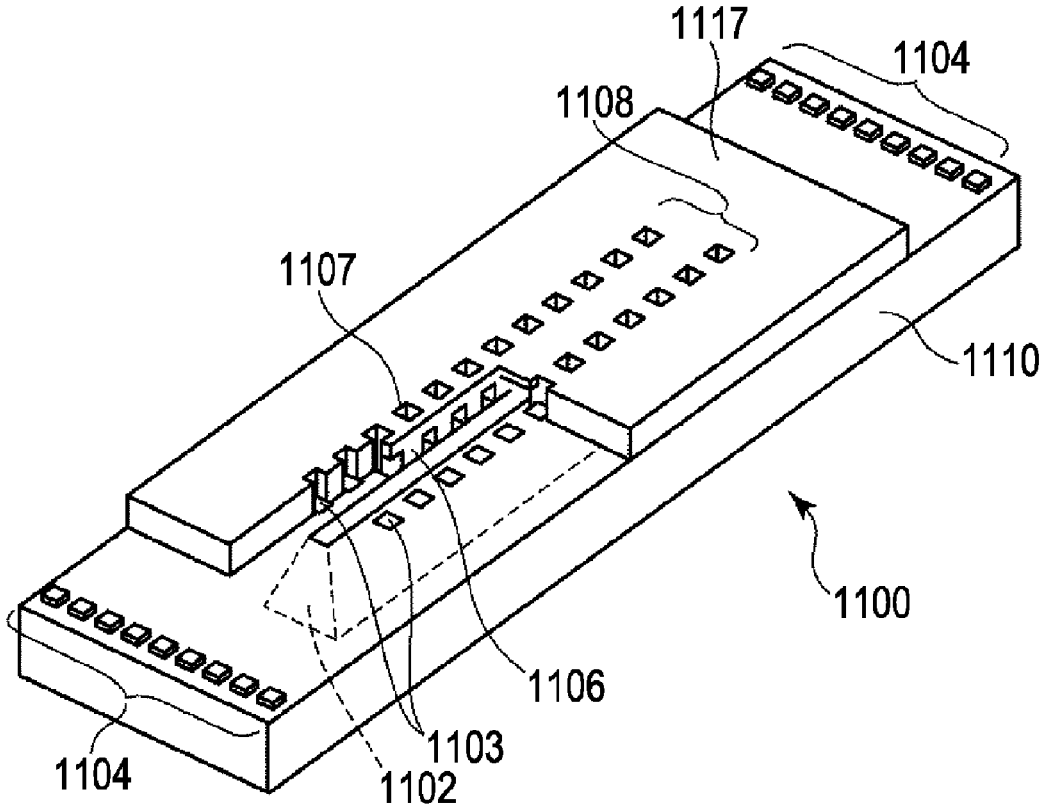
FIG. 6 is a diagram illustrating an example configuration of the head substrate and recording head of the present invention.

FIG. 6 is a partial broken-out perspective view for describing the configuration of the head substrate 1100. This diagram is shown as a representative example of a head substrate having an ink discharge port, but other than having a configuration wherein the configuration having three ink supply ports are in a configuration of three rows, is roughly the same configuration as the configuration shown in the diagram.

A head substrate 1100 has a substrate 1110 with an ink supply port 1102 formed therein which is a penetrated port for flowing ink from the back face of the substrate of a Si substrate with a thickness of 0.5 mm to 1 mm.

The substrate 1110 has electric heat converting elements 1103 arrayed on both sides sandwiching the ink supply port 1102 along the ink supply port (with the present example, the electric heat converting elements 1103 are disposed linearly in on row on both sides of the ink supply port). Further, electric wiring (not shown) configured with aluminum (Al) or the like to supply power to the electrical heat converting elements 1103 is arrayed at a predetermined distance from the ink supply port 1102. The electrical heat converting elements 1103 and electric wiring can be formed using a known film-forming technique.

The electrical heat converting elements 1103 in each row of the present example are arrayed sandwiching the ink supply port such that the elements are staggered as to one another. That is to say, the location of the discharge port 1107 for each row is disposed somewhat shifted so as not to be arrayed orthogonal to the row direction thereof. It is also noted that configurations other than a staggered array are also included in the present invention.

Also, the substrate 1110 has electrode portions 1104 (connection terminals) for supplying power to the electric wiring or for supplying an electric signal to drive the electrical heat converting elements 1103, the electrode portions 1104 being arrayed along the end portion of the side whereupon the row of electrical heat converting elements 1103 are located in rows on either side.

Also, a constructed unit made up of resin material configuring the ink flow path is formed with a photolithography technique, corresponding to the electrical heat converting elements 1103, is formed on the face of the substrate 1110 whereupon a recording element pattern is formed by configuring with wiring and electrical heat converting elements 1103. This constructed unit has an ink flow wall 1106 to divide the ink paths and a ceiling unit 1117 to cover the upper portion thereof, wherein discharge ports 1107 are opened in the ceiling portion. The discharge ports 1107 are provided facing each of the electrical heat converting elements 1103, thus forming the discharge group 1108.

With the recording head 3 thus configured, the ink supplied from the ink flow path 1102 is discharged from the discharge port 1107 facing the electrical heat converting elements 1103 by the pressure of the air bubbles generated by the heating of the electrical heat converting elements 1103.

As described above, the ink cartridge 6 and the recording head 3 may be configured separately, but a convertible head cartridge IJC which forms these in an integrated manner may be used.

Figure 7:
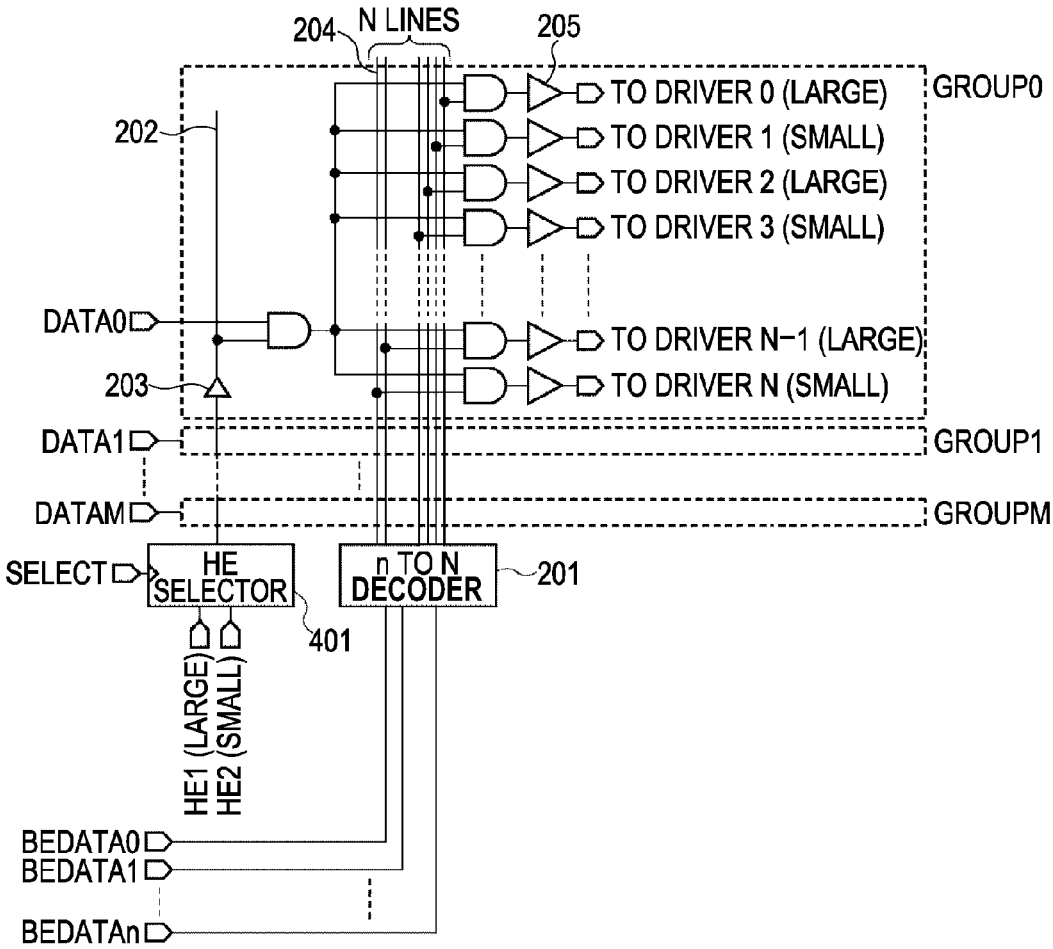
FIG. 7 is a circuit configuration diagram of an example logic circuit 104 according to a first embodiment.

FIG. 7 shows an inner circuit diagram of the logic portion which is built in to the element substrate of the present invention and applied to the first embodiment of the present invention. Note that the other circuit block disposition on the substrate is the same and/or similar to the disposition in FIG. 1 as described. The heater 102 has the same and/or similar configuration as the description with FIG. 2 when performing driving of M groups of N units each, as with FIGS. 1 and 2. However, an example is shown wherein differing types of heaters controlled with two types of heat-enable signals are disposed with the N heaters within the group differing in heater driving time period (heating time).

With regard to the subject embodiment, a case will be shown wherein discharge liquid droplet amounts differ according to the HE signal, for example. For example, let us say that an HE signal corresponds to HE1 for discharging large droplets and HE2 for discharging small droplets, wherein the heaters for the large droplets and small droplets driven by the HE signal are alternately disposed. When the large droplets are discharged, the HE signal for the large droplet discharging drives the large droplet discharging heater for a regulated amount of time, and when the small droplets are discharged, the HE signal for the small droplet discharging drives the small droplet discharging heater for a regulated amount of time. Note that the difference between the large droplet discharging heater and small droplet discharging heater may be in the area of the heater or in the resistance values or the like.

Figure 3:
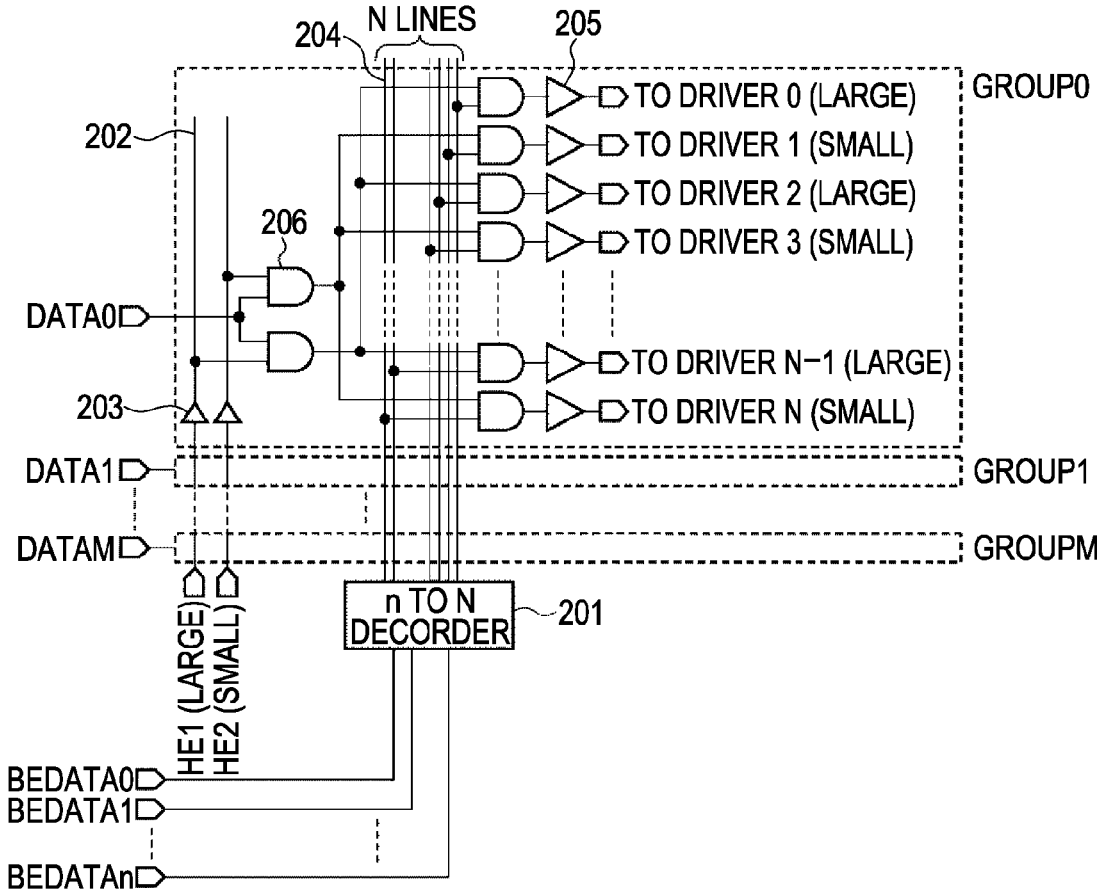
FIG. 3 PRIOR ART
FIG. 3 is a circuit configuration diagram of a logic circuit 104 of a known form driven by two types of heat-enable signals.

With a known configuration, two HE wires are input in the logic circuit within the group, as shown in FIG. 3, wherein the HE signal according to the liquid droplet amount and the driver corresponding thereto are connected. The form of a logic circuit within the group with the present example has one HE signal wire as shown in FIG. 7, and has a simple circuit configuration similar to the case with FIG. 2 wherein there is one HE signal. Instead an HE selector circuit 401 as a selection circuit for selecting the HE signal is added onto the substrate end portion. Differing types of HE signals wherein the pulse widths and so forth differ are input each with differing signal wires into the HE selector circuit, and a heater driven when a heater at a given location is to be driven selects and outputs the HE signal from the SELECT signal input externally corresponding to whether the signal is for large droplets or small droplets.

FIG. 7 shows one example of an HE selector circuit configuration and logic chart according to the first embodiment. As shown in the logic chart, when the logic of SELECT is High, the logic of HE2 is output as is to HE_OUT, and when the logic of SELECT is Low, the logic of HE1 is output as is to HE_OUT. As can be seen from the circuit diagram, the HE selector circuit is made up of simple logic configuration, and the circuit layout area can also be formed to be smaller, using the present embodiment enables the number of wires for the HE signal to also be reduced and overall significant shrinking to be realized.

Also, even if the supplying timing to the heads of the differing HE1 and HE2 are overlapped, selection is made within the head substrate so erroneous operation will not occur.

Also, a heat selector circuit is positioned for every two heat rows or the like corresponding to each heater row or ink supply port, whereby simultaneously performing heater driving with differing HE signals can be performed for each row.

Figure 1:
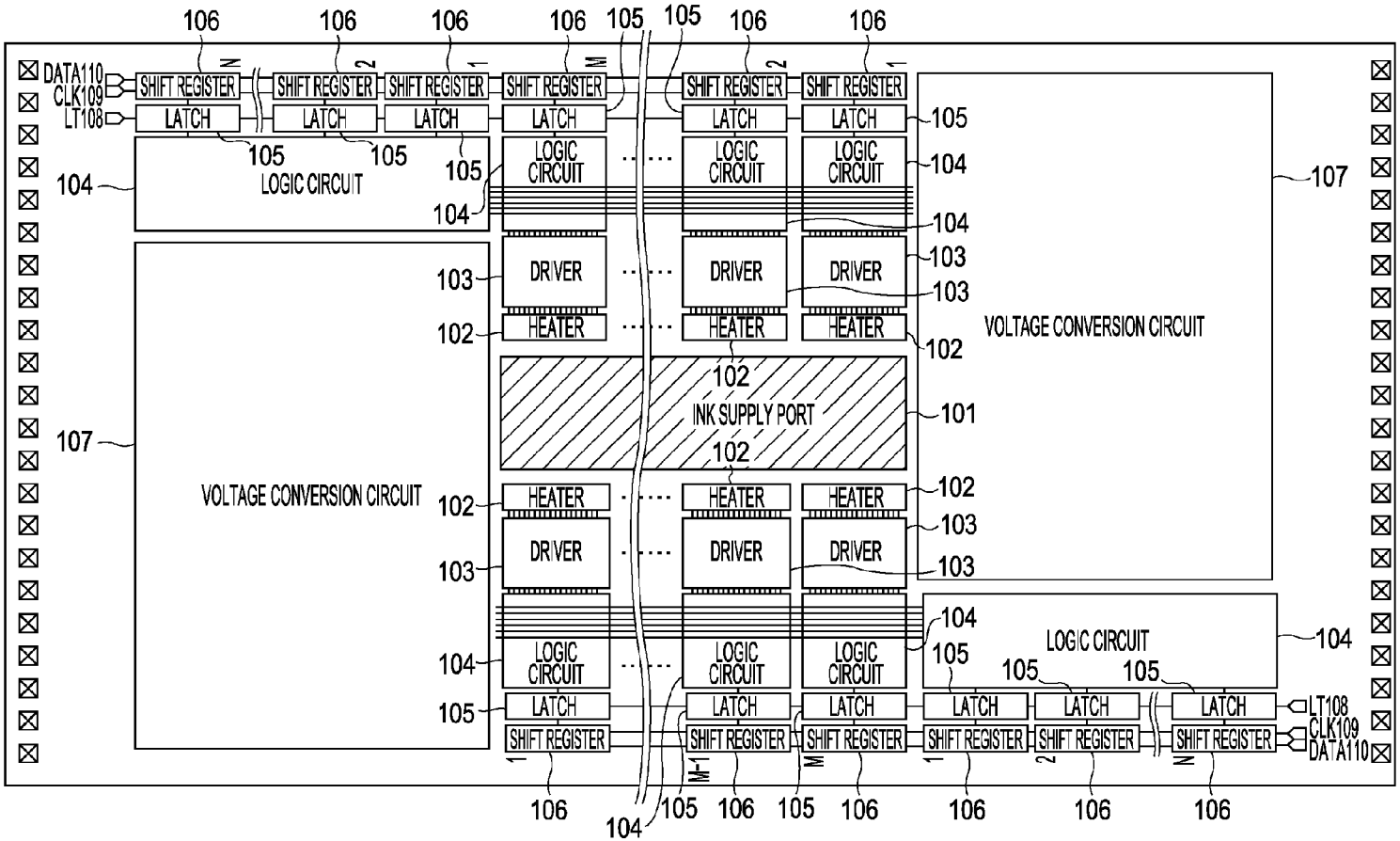
FIG. 1 PRIOR ART
FIG. 1 is a circuit block diagram of a head substrate described in known and first through fourth embodiments.
Figure 11:
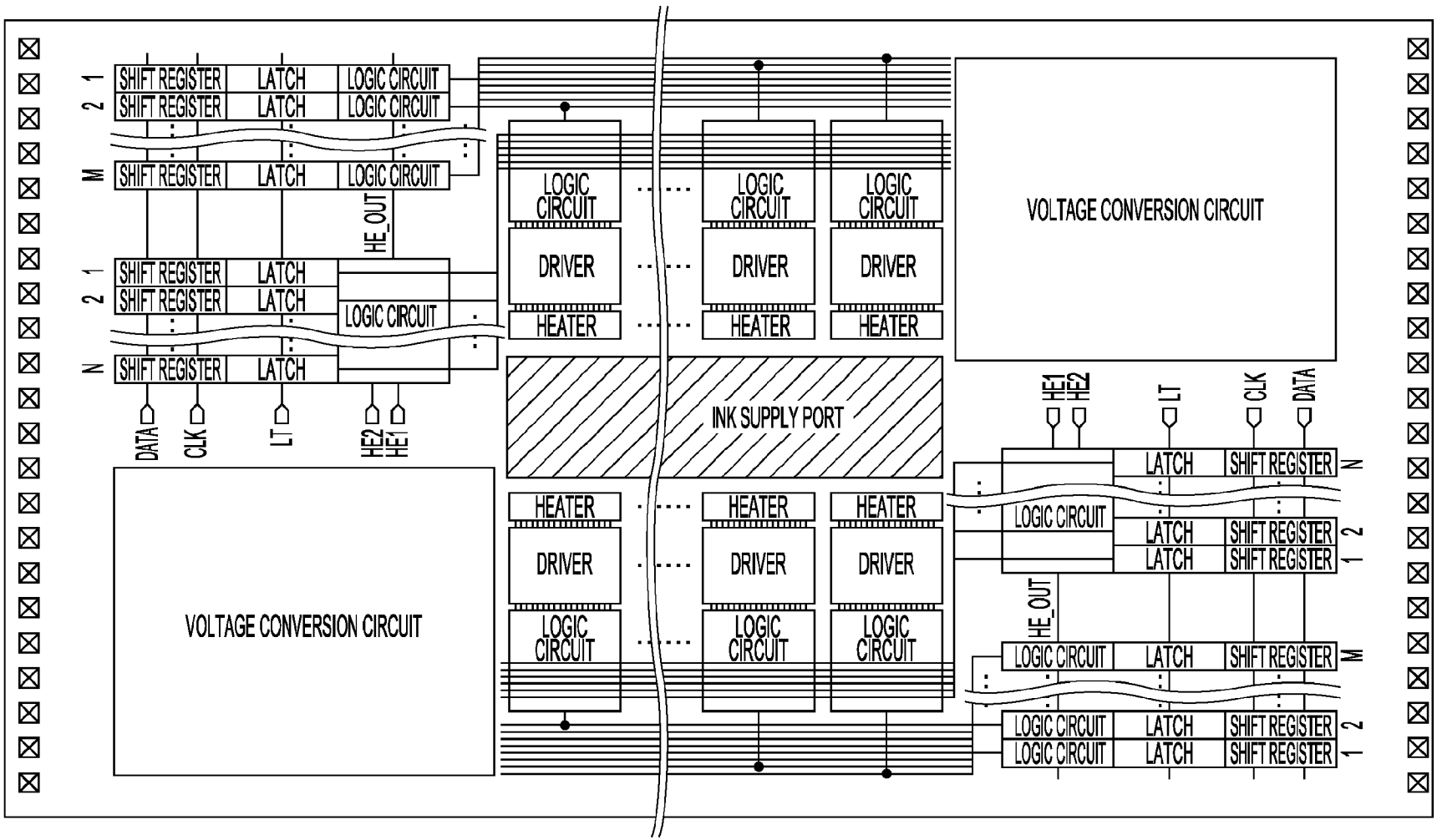
FIG. 11 is a block diagram of a circuit on a head substrate according to known and first and second embodiments.

A configuration is described here corresponding to the long length head shown in FIG. 1, but similar advantages can be obtained with another configuration wherein the shift register, latch circuit, or the like, are at the substrate end portion such as shown in FIG. 11.

Note that even in the case wherein the discharge amount does not differ, the present invention is applicable in the case of needed to use a differing heat-enabler.

Second Exemplary Embodiment

Figure 8:
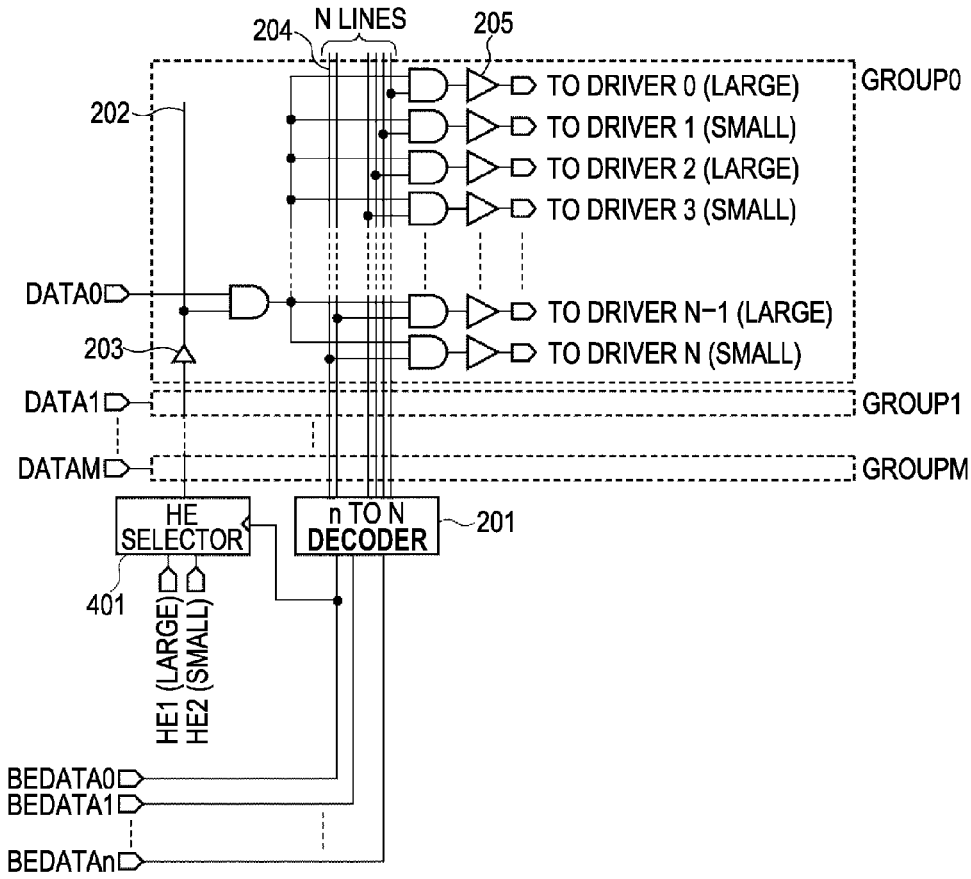
FIG. 8 is a circuit configuration diagram of an example logic circuit 104 according to second through fourth embodiments.

FIG. 8 shows an inner circuit diagram of a logic unit applicable to a second embodiment of the present invention. With the present embodiment also, similar to the first embodiment, the heaters 102 are divided into M groups of N units each, and N heaters within the group have heaters controlled by two types of HE signals disposed therein.

As an example here also, a case for obtaining an HE signal in order to discharge differing discharge liquid droplet amounts in a stable manner is shown. The relation of the discharge liquid droplet amounts and the HE signals, and the disposition of the heaters, are similar to the first embodiment so the description thereof will be omitted here.

A form of the logic circuit within the group of the present embodiment has the same simple circuit configuration as the first embodiment, but the signal input into the HE selector circuit 401 on the head substrate end portion differs. With the HE selector circuit 401 of the substrate end portion, when the heater of a given location is to be driven, the heater thereof determines whether the heater is for large droplets or for small droplets based on the serial data for heater selection, and selects and output the HE signal corresponding thereto. As described above, the heaters for large droplets and for small droplets are disposed alternately, and are in a configuration wherein the heater driven simultaneously in the same row is either for large or small, and heaters for large droplets and for small droplets are not driven simultaneously. In the case of selecting HE signals for the two types of large and small, the driven heater is determined by which even number or which odd number. As an example of the determining method, the lowest digit of the time-sharing control signal (BEDATA) is employed.

FIG. 9 shows a conversion chart of a 4 to 16 decoder, as an example of an n to N decoder. In this case a heater with the group having 16 bits (=N) from the DATA of 4 bits (=n) is selected, but the bottom of the first column of the BEDATA (BETATA 1) can determine whether the heater driven by High or Low is which odd-numbered row or which even-numbered row.

The circuit configuration of the HE selector is similar to the configuration shown with the first embodiment, but the bottom of the first column of the BEDATA (BEDATA 1) is input as the SELECT signal. Thus, as with the first embodiment, large and small heaters to be driven are disposed alternately, whereby the circuit layout area can be formed to be smaller, thereby overall shrinking can be realized, and inputting the SELECT signal externally is no longer necessary. Therefore, compared to the first embodiment, further advantages can be obtained such as reduction in the number of signals, improvement in connection reliability, reduction in circuit layout area, and so forth.

The HE selector circuit is configured primarily using a NAND circuit, but the HE selector circuit may be configured using another logic configuration. Also, the bottom of the first column of the BEDATA is used here as a selection method for an HE signal, but another portion of serial data may be employed.

Also, with the present example, and example using a time-shared control signal before decoding is shown, but the clock selection signal after decoding may also be used.

Third Exemplary Embodiment

With the first and second embodiments, a configuration has been described wherein two types of HE signals are input into the same heater row, but with the third embodiment, a configuration with three or more types will be described. Also, the case wherein discharge liquid droplet amounts differ according to the HE signal will be described.

First, the case wherein as an example three types of liquid droplet amounts of large, medium, and small are discharged within the same heater row. The three types of heaters for discharge large, medium, and small droplets are disposed similarly in the entire group sequentially within the group as large, medium, large, small, large, medium, large, small, and so on. In the case of such an array, similar to the first embodiment, the odd number within the group is a large droplet heater, and the even number is an medium or small heater. Next, regarding the array patterns of medium droplets and small droplets, when considered in a binary manner this can be distinguished based on whether the bottom of the second column is an odd number or even number. That is to say, the circuit configuration shown in FIG. 7 of the first embodiment is used in two stages, connections are made as shown in FIG. 12, and logic of the bottom of the first column (BEDATA 1) of the BEDATA is input into the selected SELECT 1 of the HE signal for whether or not to use large droplets. Also, the logic of the bottom of the second column (BEDATA 2) is input into the selected SELECT 2 of the HE signal for medium and small droplets, and if determination is made, the HE signal selection circuit can be configured with the three types of large, medium, and small.

Figure 10:
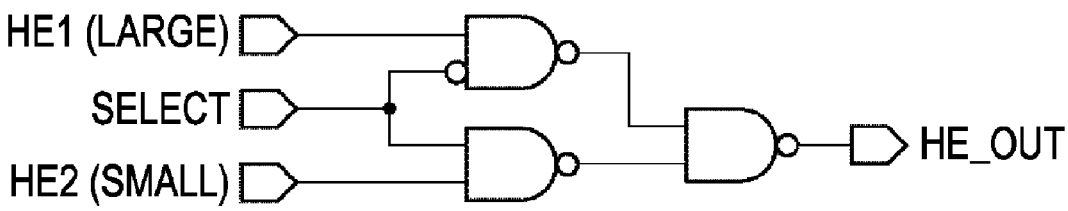
FIG. 10 is a circuit diagram illustrating an HE selector 401 according to first and second embodiments.

Thus, by employing the logic of the BEDATA with n bits and combining the circuit in FIG. 10 with many stages, a selection circuit for multiple types of HE signals can be configured. A heater selection serial data is used here as a heat selection signal, but the SELECT signal may be input externally as with the first embodiment.

The HE selector circuit is configured here by combining the circuit configuration in FIG. 10, but the HE selector circuit may be configured employing other logic configurations.

Fourth Exemplary Embodiment

With the second and third embodiment, 1 through n BEDATA is employed as selection means for the HE signal of the HE selector circuit, but with the present embodiment, the output of the n to N DECODER (BLE signal) is employed.

Figure 13:
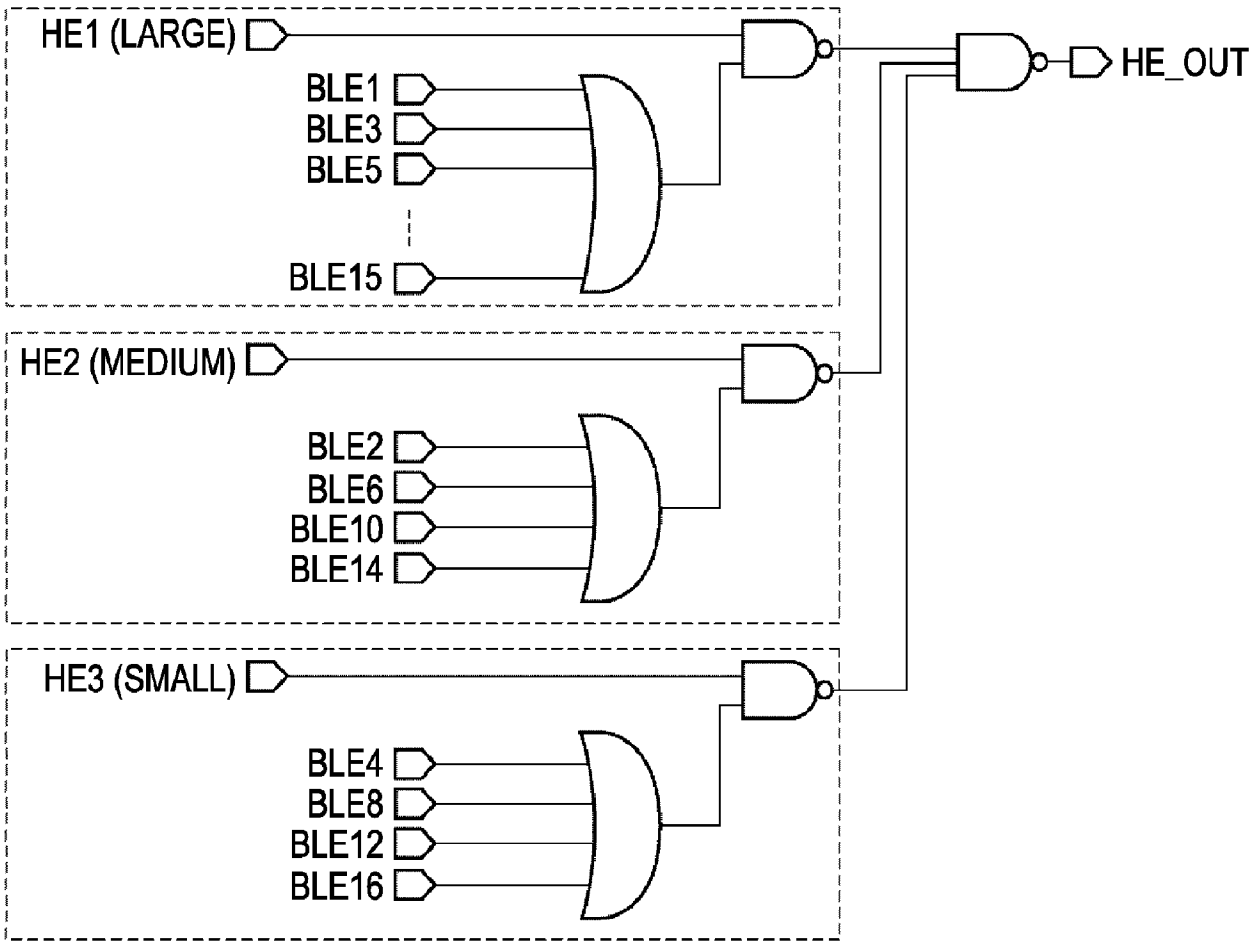
FIG. 13 is a circuit diagram illustrating an HE selector 401 according to a fourth embodiment.

As an example, the heater in the group has 16 bits (=N), and similar to the second embodiment, the heaters for the large, medium, and small droplets within a similar group are disposed similarly for all groups sequentially as large, medium, large, small, large, medium, large, small, and so on. The HE selector circuit in this case has a configuration such as that shown in FIG. 13. The logic chart will be omitted since the number of patterns is huge, but here the bits driven by the same HE signals are one pair, and the HE signal is selected by taking the OR logic of the HE signals corresponding thereto.

With the second and third embodiments, the configuration of selector circuits has been difficult if the multiple types of heaters are not arrayed in a regulated manner, but with the present embodiment, the bits employing the same HE signal all take the OR logic together. Therefore, regulated heater arrays are not necessary, and even with an unregulated array, the heaters can be handled easily.

A NOR circuit and NAND circuit are used to configure the HE selector circuits, but the HE selector circuit may be configured employing another logic configuration.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-346200 filed Dec. 22, 2006, which is hereby incorporated by reference herein in its entirety.

What is claimed is:

1. A liquid discharge head substrate comprising:

an array of heaters, where first and second type heaters which discharge relatively different amounts of liquid are arranged in a predetermined direction, and where the first and second type heaters are divided in a first group and a second group along the predetermined direction;

a first selection circuit configured to receive a plurality of time-sharing control signals for regulating the driving time period for the heater to selectively drive the plurality of heaters and configured to output block selection signals;

a second selection circuit configured to receive a first type heat-enable signals corresponding to the first type-heater and a second type heat-enable signal corresponding to the second type heater, and configured to output a heat-enable signal by selecting one of the first and the second types of heat-enable signals based on a selection signal which is input externally;

a first logic circuit configured to control driving of the first and second type heaters in the first group; and a second logic circuit configured to control driving of the first and second type heaters in the second group, wherein the first logic circuit comprises a first gate circuit configured to output a first logic signal generated by a logic operation based on first recording data and the heat-enable signal and a second gate circuit configured to output a second logic signal generated by a logic operation based on the first logic signal and the block selection signals, wherein the first gate circuit is configured to output the first logic signal for controlling driving of each heater of the first logic circuit, wherein the second logic circuit comprises a third gate circuit configured to output a third logic signal generated by a logic operation based on second recording data and the heat-enable signal and a fourth gate circuit configured to output a fourth logic signal generated by the logic operation based on the third logic signal and the block selection signals, wherein the third gate circuit is configured to output the third logic signal for controlling driving of each heater of the second logic circuit, wherein the heat-enable signal which the second selection circuit outputs is supplied to the first gate circuit in the first logic circuit and the third gate circuit in the second logic circuit via one common signal line.

2. The liquid discharge head substrate according to claim 1, wherein a surface area in the first type heater is different from a surface area in the second type heater.

3. The liquid discharge head substrate according to claim 1, wherein a pulse width of the first type heat-enable signal is different from a pulse width of the second type heat-enable signal.

4. A liquid discharge head for discharging liquid from discharge ports, comprising:

a liquid discharge head substrate including, an array of heaters, where first and second type heaters which discharge relatively different amounts of liquid are arranged alternately in a predetermined direction, and where the first and second type heaters are divided in a first group and a second group along the predetermined direction;

a first selection circuit configured to receive a plurality of time-sharing control signals for regulating the driving time period for the heater to selectively drive the plurality of heaters and configured to output block selection signals; and a second selection circuit configured to receive a first type heat-enable signal corresponding to the first type heater and a second type heat-enable signal corresponding to the second type heater, and configured to output a heat-enable signal by selecting one of the first and the second types of heat-enable signals based on a selection signal which is input externally;

a first logic circuit configured to control driving of the first and second type heaters in the first group;

a second logic circuit configured to control driving of the first and second type heaters in the second group; and discharge ports provided corresponding to each of the heaters, wherein the first logic circuit comprises a first gate circuit configured to output a first logic signal generated by a logic operation based on first recording data and the heat-enable signal and a second gate circuit configured to output a second logic signal generated by a logic operation based on the first logic signal and the block selection signals, wherein the first gate circuit is configured to output the first logic signal for controlling driving of each heater of the first logic circuit, wherein the second logic circuit comprises a third gate circuit configured to output a third logic signal generated by a logic operation based on second recording data and the heat-enable signal and a fourth gate circuit configured to output a fourth logic signal generated by the logic operation based on the third logic signal and the block selection signals, wherein the third gate circuit is configured to output the third logic signal for controlling driving of each heater of the second logic circuit, wherein the heat-enable signal which the second selection circuit outputs is supplied to the first gate circuit in the first logic circuit and the third gate circuit in the second logic circuit via one common signal line.

* * * * *